US005367228A

United States Patent [19]

Kachmarik et al.

[11] Patent Number: 5,367,228

[45] Date of Patent: Nov. 22, 1994

[54] HIGH-PRESSURE SODIUM LAMP CONTROL CIRCUIT PROVIDING CONSTANT PEAK CURRENT AND COLOR

[75] Inventors: David J. Kachmarik, North Olmsted; Louis R. Nerone, Brecksville; Douglas M. Rutan, Cleveland Heights, all of Ohio

[73] Assignee: General Electric Company, Schenectady, N.Y.

[21] Appl. No.: 972,036

[22] Filed: Nov. 5, 1992

[51] Int. Cl.[5] ..... G05F 1/00

[52] U.S. Cl. ..... 315/307; 315/209 R; 315/224; 315/DIG. 7

[58] Field of Search ..... 315/307, 209 R, 224, 315/291, DIG. 5, DIG. 7

[56] References Cited

U.S. PATENT DOCUMENTS

| | | | |
|---|---|---|---|
| 4,535,271 | 8/1985 | Holmes | 315/307 X |
| 4,928,038 | 5/1990 | Nerone | 315/209 R |
| 5,128,592 | 7/1992 | Dean et al. | 315/224 |

*Primary Examiner*—Robert J. Pascal

*Assistant Examiner*—Haissa Philogene

*Attorney, Agent, or Firm*—George E. Hawranko; Stanely C. Corwin

[57] ABSTRACT

The present invention is directed to a control circuit for providing a substantially constant current to a high-pressure sodium lamp. The control circuit preferably comprises a circuit for providing a rectified voltage signal, and a ballast having first and second contacts to operatively connect the lamp therebetween. The ballast generates and controls a peak current through the lamp based on the value of a controlled voltage. The control circuit further comprises a current sensor to sense the amount of current through the lamp, and a buck-boost voltage control circuit to control the value of the controlled voltage in order to provide a substantially constant peak current through the lamp based on the amount of current sensed by the current sensor. By controlling the amount of voltage seen by the lamp, the buck-boost voltage control circuit controls the amount of current through the lamp, thereby providing constant color temperature regardless of the fluctuations in lamp impedance.

12 Claims, 2 Drawing Sheets

HIGH-PRESSURE SODIUM LAMP CONTROL CIRCUIT PROVIDING CONSTANT PEAK CURRENT AND COLOR

CROSS-REFERENCE TO A RELATED APPLICATIONS

The present application is related to U.S. patent application serial number (U.S. Ser. No. 07/971,806) entitled "Circuit and Method For Operating High Pressure Sodium Vapor Lamps" (attorney docket LD 10,203), and U.S. patent application serial number (U.S. Ser. No. 07/971,791) entitled "Feedback-Controlled Circuit and Method For Powering A High Intensity Discharge Lamp" (attorney docket LD 10,346), both filed even-date herewith, assigned to the same assignee as the present invention and herein incorporated by reference.

FIELD OF THE INVENTION

The present invention is directed to the operation of high-pressure sodium lamps. More particularly, the present invention is directed to a high-pressure sodium lamp control circuit which provides a constant peak current through the lamp, thereby providing a constant lamp color.

BACKGROUND OF THE INVENTION

High-pressure sodium lamps are well known in the art and are widely used for street, roadway and other outdoor lighting applications. A high-pressure sodium lamp typically consists of a cylindrical transparent or translucent arc tube which contains pressurized sodium vapor.

The arc tube generally has a pair of electrodes therein, and a current flows through the sodium vapor in the arc tube to excite the sodium atoms. The current is preferably an ac current, which typically offers an increased service life relative to a dc current. The energy which is given off by the excitation and relaxation of the sodium ions is converted into visible light and heat.

The arc tube is generally enclosed in a glass bulb or similar outer jacket to isolate the arc tube from the environment, thereby preventing oxidation of the electrodes and other metallic parts, stabilizing the operating temperature of the lamp and significantly reducing any ultraviolet radiation emitted by the excitation of the sodium ions.

In the art of illumination, the color temperature refers to the absolute temperature (in degrees Kelvin) of a blackbody radiator whose chromaticity most nearly resembles that of the light source.

As appreciated by those skilled in the art, the color temperature of a high-pressure sodium lamp is a function of the peak current through the lamp. The color temperature determines the hue of the light produced by the lamp, commonly referred to as lamp color. It is considered important in the art to maintain a desired peak current so that the lamp will have a desired lamp color.

Peak current through the lamp is a function of the lamp's internal impedance. One of the problems associated with the operation of high-pressure sodium lamps is that the impedance of the lamp varies over time, both due to internal temperature effects, as well as due to the deterioration of the lamp over its service life.

Additionally, variations in lamp impedance exist from one lamp to another due to manufacturing tolerances, whether from the same manufacturer or from one manufacturer to another.

Thus, the internal impedance of a lamp will vary over time, and the internal impedance of any replacement lamp will also vary, relative to the internal impedance of the initial lamp. Accordingly, it has heretofore been difficult to maintain a constant peak current through a lamp given the fluctuation in lamp impedance and hence maintain a substantially uniform lamp color.

SUMMARY OF THE INVENTION

The present invention is directed to a control circuit for providing a substantially constant peak current to a high-pressure sodium lamp. The control circuit preferably comprises a circuit for providing a rectified voltage signal, a buck-boost voltage control circuit to control the value of a voltage, and a ballast to control the peak current through a lamp based on the value of the controlled voltage.

The ballast preferably comprises a first and second switch, a series combination of a resonant tank circuit, first and second contacts, and a power control circuit. The lamp is connectable between the first and second contacts.

A current sensor is preferably provided to sense the amount of current through the lamp, and a voltage sensor is preferably provided to sense the amount of controlled voltage provided by the buck-boost voltage control circuit.

The buck-boost voltage control circuit controls the value of the controlled voltage, which is seen across the series combination of the lamp and the resonant tank circuit, based on the value of the peak current through the lamp. By controlling the value of the voltage across the lamp, the buck-boost circuit controls the peak current through the lamp. Thus, the circuit of the present invention provides a constant lamp color regardless of fluctuations in lamp impedance.

The power control circuit operates the first and second switches of the ballast, thereby controlling the application of the controlled voltage across the series combination of the lamp and resonant tank circuit. The power control circuit, in combination with the resonant tank circuit, provides bi-directional ac current to the lamp.

The power control circuit controls the switching rate of the first and second switches, preferably based on the amount of current sensed through the lamp and the amount of voltage sensed across the lamp. By controlling the rate at which the first and second switches are switched, the power through the lamp can be controlled.

The resonant tank circuit preferably comprises an inductor and two capacitors. When the controlled voltage is switched across the series combination of the resonant tank and the lamp, the inductor current, lamp current and capacitor voltage will begin to resonate and the inductor and capacitors will begin to store energy. When the voltage potential of the capacitors reaches the value of the controlled voltage, the capacitor voltage value is clamped and the energy stored in the inductor is released as current through the lamp in the same direction as caused by the controlled voltage.

The energy in the inductor is released in an exponential fashion. At some time after the inductor is fully discharged, the controlled voltage is removed from the series combination of the resonant tank and the lamp.

The voltage potential in the capacitors begins to discharge through the lamp and inductor, causing current to flow therethrough in an opposite direction, relative to the direction of current caused by the controlled voltage. The current through the inductor causes energy to be stored therein. When the potential in the capacitors is fully discharged, the energy stored in the inductor is released as current through the lamp in the same direction as caused by the discharging capacitors.

At some time after the energy in the inductor is fully discharged, the power control circuit again applies the controlled voltage across the series combination of the resonant tank circuit and the lamp, thereby repeating the process.

The first and second switches each have a controllable input to which a polarized transformer leg is connected. The polarity of the leg attached to the first switch, however, is opposite that of the polarity of the leg attached to the second switch. The power control circuit preferably comprises a controller connected to a third polarized leg. By controlling the relative polarity of the third leg, the operation of the first and second switches can be controlled.

The buck-boost voltage control circuit preferably comprises an energy storage device which stores energy releasable as the control voltage, and a voltage control circuit to control the amount of energy stored therein. The voltage control circuit controls the value of the controlled voltage based on the peak current through the lamp.

The voltage control circuit preferably comprises a third switch controllably connecting the energy storage device to ground. The voltage control circuit preferably further comprises a peak hold circuit connected to the current sensor and a controller to control the operation of the third switch. When the energy storage device is connected to ground, energy builds up therein. When disconnected from ground, the stored energy is converted by the circuit into the controlled voltage which is applied across the lamp.

BRIEF DESCRIPTION OF THE DRAWINGS

In the following detailed description of the invention, reference will be made to the attached drawings in which.

DESCRIPTION OF THE PREFERRED EMBODIMENTS

Figure 1:
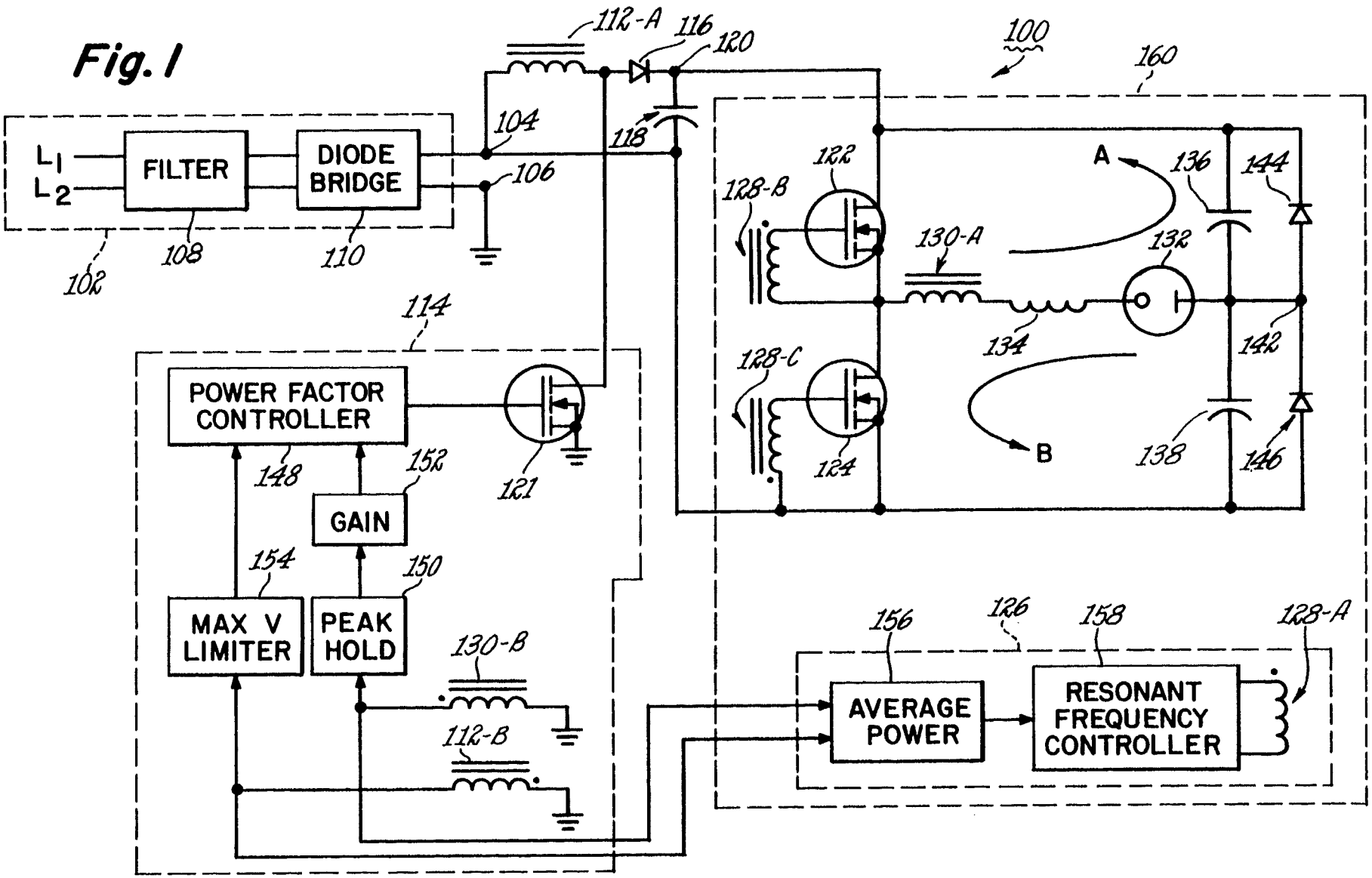
FIG. 1 is a schematic block diagram of the preferred embodiment of the circuit of the present invention.

Turning now to FIG. 1, a schematic block diagram of the preferred embodiment of the circuit of the present invention is shown. Circuit 100 preferably comprises power conditioning circuit 102 to provide a full wave rectified ac voltage between nodes 104 and 106. The power conditioning circuit preferably includes filter 108 and diode bridge 110.

The filter is preferably an electromagnetic interference filter, to filter noise out from lines L1 and L2. Although the line voltage at L1 and L2 is preferably about 120 vac at 60 Hertz, the circuit of the present invention can accommodate any line voltage and frequency. Diode bridge 110 converts the filtered line voltage from filter 108 into a full wave rectified ac voltage between nodes 104 and 106.

Transformer 112, preferably a voltage transformer, includes leg 112A, which functions as an inductor, and leg 112B, which functions as a tap. Leg 112A stores energy therein when connected to ground via voltage control circuit 114, and releases the stored energy when the ground path is disconnected. When released, the stored energy in leg 112A surges through diode 116 and across capacitor 118. In the preferred embodiment, leg 112A has an inductance value of about 172 microhenries (μH) and capacitor 118 is about 470 microfarads (μF).

The voltage at node 120 is variable, both above and below the value of the voltage at node 104, and is controlled by voltage control circuit 114, via the switching frequency of FET 121, the operation of which is explained in more detail below. As will be appreciated by those skilled in the art, given the control over of the voltage value at node 120 relative to that at node 104, voltage control circuit 114, in combination with leg 112A and capacitor 118, can be described as a buck-boost converter or as a buck-boost voltage control circuit.

Ballast 160 controls the peak current through the lamp based on the voltage at node 120. The operation of ballast 160, described generally hereinbelow, is described in detail in previously cross-referenced U.S. patent applications serial number (to be assigned) entitled "Circuit and Method For Operating High Pressure Sodium Vapor Lamps" (attorney docket LD 10,203), and U.S. patent application serial number (to be assigned) entitled "Feedback-Controlled Circuit and Method For Powering A High Intensity Discharge Lamp" (attorney docket LD 10,346).

The operation of FET 122 and FET 124 are controlled by power control circuit 126 via controlling the polarity of current through transformer leg 128A. When transformer leg 128A is forward-biased, transformer leg 128B is forward-biased, current flows therethrough and FET 122 turns on. When transformer leg 128A is forward-biased. transformer leg 128C is reverse-biased, no current flows therethrough and FET 124 is off. Conversely, when transformer leg 128A is reverse-biased, transformer leg 128C is forward-biased, current flows therethrough and FET 124 turns on. When transformer leg 128A is reverse-biased, transformer leg 128B is reverse-biased, no current flows therethrough and FET 122 is off.

As FETs 122 and 124 are switched, the voltage at node 120 is applied across the series combination of transformer leg 130A, lamp 132 and a resonant tank circuit comprising resonant inductor 134 and resonant capacitors 136 and 138. In the preferred embodiment, resonant inductor is about 500 μH and capacitors 136 and 138 are about 2 μF each.

Figure 2:
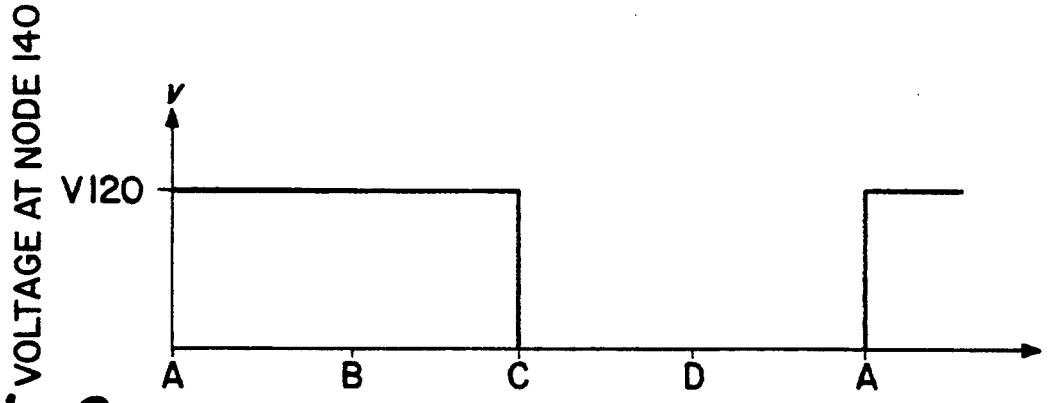
FIG. 2 represents a simplified waveform of the voltage at node 140 in the circuit of FIG. 1.
Figure 3:
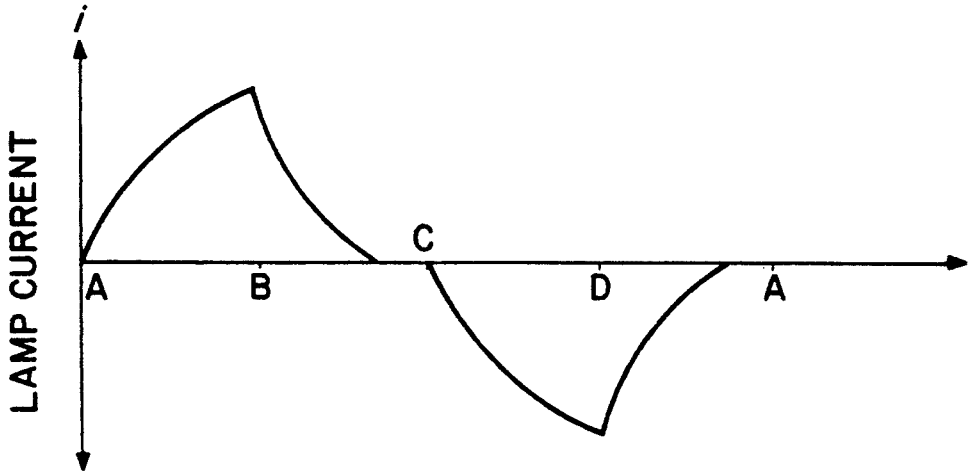
FIG. 3 represents a simplified waveform of the current through lamp 132 in the circuit of FIG. 1.
Figure 4:
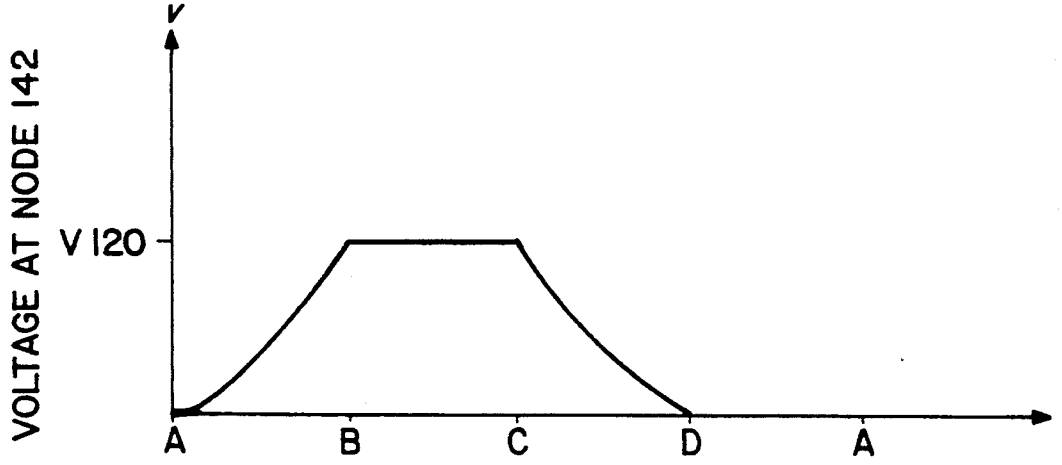
FIG. 4 represents a simplified waveform of the voltage at node 142 in the circuit of FIG. 1.

With reference to FIGS. 2 through 4, when FET 122 turns on, the voltage at node 140 jumps to the voltage at node 120 (reference point A, FIG. 2) and the voltage at node 142 is zero (reference point A, FIG. 4). Thus, current flows in direction A through leg 130A, inductor 134, lamp 132, capacitor 136 and FET 122. The current flow through the lamp increases in a resonant fashion as inductor 134 begins charging (interval A-B, FIG. 3), while the voltage at node 142 increases in a resonant fashion as capacitor 138 begins charging (interval A-B, FIG. 4).

By definition, the voltage at node 142 wants to increase to twice the voltage at node 120. However, when the voltage across capacitor 138 reaches the value of the voltage at node 120, diode 144 clamps capacitor 136 and diode 144 begins to conduct the current.

Additionally, the energy stored in inductor 134 is released as current, discharging in a resonant fashion in direction A through lamp 132, diode 144, FET 122 and leg 130A until the energy therein is fully discharged (interval B-C, FIG. 3). As will be appreciated by those skilled in the art, the rate of exponential decay is based on the inductance value of inductor 134 and the impedance value of lamp 132.

In the preferred embodiment, transformer 130 is a current transformer and the current through leg 130A, indicative of the current through lamp 132, is sensed by leg 130B. At some point after inductor 134 is fully discharged and the current through lamp 132 is zero, power control circuit 126 reverses the polarity of the current through leg 128A, turning FET 124 on and FET 122 off.

When FET 124 turns on, the voltage at node 140 is zero (reference point C, FIG. 2), while the voltage at node 142 is at the voltage value of node 120 (reference point C, FIG. 4), based on the charge stored in capacitor 138. The voltage difference between node 142 and node 140 causes current to flow in direction B through lamp 132, inductor 134, leg 130A and FET 124. The current flow through the lamp increases in a resonant fashion as inductor 134 begins charging (interval C-D, FIG. 3). As current flows, the charge stored in capacitor 138 begins to decrease exponentially, until the voltage at node 142 is zero (interval C-D, FIG. 4).

When the voltage at node 142 is zero (reference point D, FIG. 4), diode 146 clamps capacitor 138, and the energy stored in inductor 134 is released as current in direction B, discharging in an exponential fashion through leg 130A, FET 124, diode 146 and lamp 132 until fully discharged (interval D-A, FIG. 3).

At some point after inductor 134 is fully discharged and the current through lamp 132 is zero, power control circuit 126 reverses the polarity of the current through leg 128A, turning FET 122 on and FET 124 off, thereby repeating the process.

As will be appreciated by those skilled in the art, the impedance of lamp 132 varies over time, both due to internal temperature effects, as well as due to the deterioration of the lamp over its service life. Additionally, variations in lamp impedance exists from one lamp to another due to manufacturing tolerances, whether from the same manufacturer or from one manufacturer to another. Thus, the internal impedance of a lamp will vary over time, and the internal impedance of any replacement lamp will also vary, relative to the internal impedance of the initial lamp.

A predetermined peak current is desired to drive lamp 132 for optimal color temperature. In order for peak current to remain constant, any variation in lamp impedance must be met with a corresponding variation in voltage across the lamp. Voltage control circuit 114 varies the amount of voltage across the lamp so as to maintain a predetermined peak current through the lamp. By varying the amount of voltage at node 120, voltage control circuit 114 controls the amount of voltage seen across lamp 132 and thus the peak current therethrough.

Voltage control circuit 114 preferably includes power factor controller 148 which operates FET 121 based on the peak amount of current through lamp 132. By switching FET 121 on and off, bursts of inductance are thrown onto the line across capacitor 118, thereby bringing the power factor substantially close to unity, e.g., 0.99.

The amount of current through leg 130A, indicative of the current through lamp 132, is sensed by leg 130B, and the peak value thereof is detected and held by peak hold circuit 150. Controller 148 compares the peak current from peak hold circuit 150 to its internal reference and adjusts the duty cycle of its output signal based on the difference thereof. The output signal from controller 148 controls the switching frequency of FET 121.

Controller 148 is preferably a buck-boost power factor controller, e.g., model ML4813 available from Micro Linear Devices. The preferred controller 148 includes therein an internal gain circuit, shown as gain circuit 152. The gain circuit is set based on the system parameters, e.g., desired peak current through the lamp. In the preferred embodiment, gain circuit 152 is set at about 2.5 for a peak lamp current of about 12 amps.

Transformer leg 112B functions as a voltage sensor which senses the amount of energy stored in transformer leg 112A and thus provides a scaled representation of the voltage at node 120. In order to provide a safety feedback to controller 148, maximum voltage limiter 154 is placed between leg 112B and controller 148. The value of the voltage at node 120 can increase above a predetermined point during the first several cycles of circuit operation before the circuit reaches steady-state. Additionally, if the lamp 132 malfunctions or is not connected, voltage at node 120 can increase above the predetermined point because controller 148 will try to increase the voltage value at node 120 to obtain a desired peak current. In the event the voltage increases beyond the predetermined point, maximum voltage limiter 154 limits the amount of voltage seen by controller 148. Controller 148, upon detecting a maximum voltage condition, will output a control signal to FET 121 having a predetermined duty cycle, switching FET 121 to provide a predetermined voltage at node 120. In the preferred embodiment. maximum voltage limiter 154 is set to about 300 volts.

As will be appreciated by those skilled in the art, a predetermined amount of power is desired through lamp 132 for optimal luminance output. With reference to FIG. 3, a dead time exists from the point at which lamp current from the discharging inductor 134 goes to zero when FETs 122 and 124 are switched. By varying the switching frequency of FETs 122 and 124, the amount of dead time over a given time interval can be controlled. Thus, by varying the switching frequency of FETs 122 and 124, power control circuit 126 controls the average power through the lamp. Power control circuit 126 preferably comprises average power circuit 156, resonant frequency controller 158 and transformer leg 128A.

Average power circuit 156 preferably determines the average power through the lamp based on the amount of current through the lamp, via leg 130B, and the amount of voltage at node 120, via leg 112B, outputting a power signal indicative thereof. Resonant frequency controller 158 compares the power signal to an internal reference value and adjusts the rate at which the polarity of the current through leg 128A is switched based on the difference thereof. In the preferred embodiment, resonant frequency controller 158 is a high performance resonant mode controller, e.g., model MC33066 available from Motorola. Additionally, transformer 128 is a voltage transformer, all three legs having an identical number of windings, e.g., 60, about a common core.

As appreciated by those skilled in the art, color temperature of a high-pressure sodium lamp is a function of the peak current through the lamp. The color temperature determines the hue of the light produced by the lamp, commonly referred to as lamp color. It is considered important in the art to maintain a desired color temperature so that the lamp will have a desired lamp color. One advantage of the circuit of the present invention is that the circuit will provide a predetermined peak current to the lamp, and thus a desired lamp color, despite any variations in internal impedance over time, whether due to internal temperature effects or due to the deterioration of the lamp over its service life. Another advantage is that the circuit will provide a predetermined peak current to the lamp, despite any difference in the internal impedance from one lamp to another due to manufacturing tolerances, whether from the same manufacturer or from one manufacturer to another. Yet another advantage is that the circuit will provide a predetermined peak current to the lamp despite severe dips and/or spikes in the ac line voltage, and is in fact operable regardless of the value of the ac line voltage. A further advantage is that the power factor of the circuit is substantially close to unity, in spite of the numerous inductors and capacitors employed therein.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What we claim as our invention is:

1. A control circuit for providing a substantially constant peak current to a high-pressure sodium lamp, said control circuit comprising:

a first and second node capable of having a rectified voltage signal electrically connected therebetween;

a ballast circuit electrically connected to said first and a third node, said ballast circuit having a first and a second contact wherein the lamp is operatively connectable between said first and second contacts, said ballast circuit to generate and control a peak current through the lamp based on the value of a voltage as said third node;

a current sensor to sense the amount of current through the lamp;

a buck-boost voltage control circuit electrically connected to said first, second and third nodes, said buck-boost voltage control circuit being effective to control the value of the voltage at said third node in order to provide a substantially constant peak current through the lamp based on the amount of current sensed by said current sensor;

wherein said buck-boost voltage control circuit includes an energy storage device, a capacitor and, a voltage control circuit to control the amount of energy stored by said energy storage device based on the amount of current sensed by said current sensor; and, wherein said voltage control circuit includes a controllable switch having a first contact electrically connected to said energy storage device and a controllable input, said voltage control circuit further including a peak hold circuit electrically connected to said current sensor and effective so as to output a peak current signal based on a peak current sensed by said current sensor, and, a controller operatively connected to the controllable input of said controllable switch so as to control the operation thereof based on said peak current signal and thus controlling the amount of energy stored in said energy storage device.

2. The control circuit of claim 1, wherein said ballast circuit comprises:

a first controllable switch operatively connected between said third node and a fourth node;

a second controllable switch operatively connected between said fourth node and said first node;

a series combination of a resonant tank circuit and said first and said second contacts, said series combination electrically connected between said fourth node and said first and third nodes;

a voltage sensor to sense the amount of voltage at said third node;

a power control circuit to operate said first and said second controllable switches based on the amount of current sensed by said current sensor and the amount of voltage sensed by said voltage sensor, said power control circuit to apply the voltage at said third node across the lamp to provide bi-directional current to the lamp.

3. The control circuit of claim 2, wherein:

said first controllable switch comprises a first terminal operatively connected to said third node, a second terminal operatively connected to said fourth node, and a controllable input;

said second controllable switch comprises a first terminal operatively connected to said fourth node, a second terminal operatively connected to said first node, and a controllable input; and said power control circuit comprises a transformer having a first, a second and a third polarized leg, said first polarized leg operatively connected between the controllable input of said first controllable switch and said fourth node, said second polarized leg operatively connected between the controllable input of said second controllable switch and said first node, wherein the direction of polarity of said first leg is opposite that of said second leg;

said power control circuit further comprises a controller operatively connected to said third polarized leg, said controller to control the relative polarity of said third polarized leg based on the amount of current sensed by said current sensor and the amount of voltage sensed by said voltage sensor, thereby controlling the operation of said first and second controllable switches.

4. The control circuit of claim 3, wherein said controller controls the relative polarity of said third polarized leg by controlling the direction of a current through said third leg.

5. The control circuit of claim 2, wherein said resonant tank circuit comprises:

an inductor electrically connected between said fourth node and said first contact;

a first capacitor electrically connected between said second contact and said third node; and a second capacitor electrically connected between said second contact and said first node.

6. The control circuit of claim 1, wherein said voltage control circuit controls the amount of voltage stored by said energy storage device based on the peak current sensed by said current sensor.

7. The control circuit of claim 1, wherein said energy storage device is a transformer leg functioning as an inductor.

8. A control circuit for providing a substantially constant current to a high-pressure sodium lamp, said control circuit comprising:

a first and a second node capable of having a rectified voltage signal electrically connected therebetween;

peak current control circuit electrically connected to said first and a third node, said peak current control circuit having a first and a second contact wherein the lamp is operatively connectable between said first and second contacts, said peak current control circuit to generate and control a peak current through the lamp based on the value of a voltage at said third node;

current sensing circuit effective so as to sense the amount of current through the lamp;

a buck-boost voltage control circuit electrically connected to said first, second and third nodes, said buck-boost converter voltage control circuit being effective for controlling the value of the voltage at said third node in order to provide a substantially constant peak current through the lamp based on the amount of lamp current sensed by said current sensing circuit;

wherein said buck-boost voltage control circuit includes an energy storage device, a capacitor and, a voltage control circuit to control the amount of energy stored by said energy storage device based on the amount of current sensed by said current sensor; and, wherein said voltage control circuit includes a controllable switch having a first contact electrically connected to said energy storage device and a controllable input, said voltage control circuit further including a peak hold circuit electrically connected to said current sensor and effective so as to output a peak current signal based on a peak current sensed by said current sensor, and, a controller operatively connected to the controllable input of said controllable switch so as to control the operation thereof based on said peak current signal and thus controlling the amount of energy stored in said energy storage device.

9. The control circuit of claim 10, wherein said energy storage device is a transformer leg functioning as an inductor.

10. A method of providing a substantially constant current to a high-pressure sodium discharge lamp, said method comprising the steps of:

applying a first voltage across a series combination of the lamp and a resonant tank circuit during a first time interval, thereby creating a current flow in the lamp in a first direction;

building up a voltage potential in the resonant tank circuit during the first time interval;

discontinuing the application of said first voltage across the series combination during a second time interval;

applying the voltage potential of the resonant tank circuit across the lamp during the second time interval, thereby creating a current flow in the lamp in a second direction;

sensing the current through the lamp;

controlling the value of the first voltage based on the amount of current sensed through the lamp;

wherein the step of sensing the current through the lamp comprises sensing the peak current through the lamp during the first and second time interval; and wherein the step of controlling the value of the first voltage comprises controlling the value of the first voltage based on the amount of peak current sensed through the lamp.

11. The method of claim 10, wherein the step of sensing the current through the lamp comprises sensing the peak current through the lamp; and wherein the step of controlling the value of the first voltage comprises controlling the value of the first voltage based on the amount of peak current sensed through the lamp.

12. The method of claim 10, said method further comprising the steps of:

sensing the value of the first voltage; and determining the duration of the first and the second time intervals based on the amount of current sensed through the lamp and the sensed value of the first voltage.

* * * * *